US012577871B2

(12) United States Patent
Rashid et al.

(10) Patent No.: US 12,577,871 B2
(45) Date of Patent: Mar. 17, 2026

(54) LINEAR CUT GENERATION METHOD FOR SENSOR INVERSION CONSTRAINT IMPOSITION

(71) Applicant: SCHLUMBERGER TECHNOLOGY CORPORATION, Sugar Land, TX (US)

(72) Inventors: Kashif Rashid, Cambridge, MA (US); Lukasz Zielinski, Cambridge, MA (US); Andrew J. Speck, Cambridge, MA (US); Junyi Yuan, Cambridge, MA (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 19/100,481

(22) PCT Filed: Aug. 3, 2023

(86) PCT No.: PCT/US2023/029361
§ 371 (c)(1),
(2) Date: Jan. 31, 2025

(87) PCT Pub. No.: WO2024/030523
PCT Pub. Date: Feb. 8, 2024

(65) Prior Publication Data

US 2025/0257652 A1 Aug. 14, 2025

Related U.S. Application Data

(60) Provisional application No. 63/370,285, filed on Aug. 3, 2022.

(51) Int. Cl.
*E21B 47/117* (2012.01)

(52) U.S. Cl.
CPC ..... *E21B 47/117* (2020.05)

(58) Field of Classification Search
CPC ..... E21B 47/117; E21B 47/10; G01W 1/02
(Continued)

(56) References Cited

U.S. PATENT DOCUMENTS 5,375,465 A * 12/1994 Carlson ..... E21B 47/10 73/152.05
6,297,504 B1 10/2001 Andreou
(Continued)

FOREIGN PATENT DOCUMENTS

CN 105067023 A 11/2015
CN 107608009 A 1/2018
(Continued)

OTHER PUBLICATIONS

Titchener et al. "Single photon Lidar gas imagers for practical and widespread continuous methane monitoring." Applied Energy 306 (2022): 118086. (11 pages).
(Continued)

*Primary Examiner* — Marrit Eyassu
(74) *Attorney, Agent, or Firm* — Kyle R. Miiller

(57) ABSTRACT

Embodiments presented provide for a method of analysis for methane leaks. The method of analysis includes performing a record generation event, performing a quality assessment of the record generation event, performing a linear cut generation procedure to create a linear cut generation data set, and performing a source term inversion using the linear cut generation data set.

19 Claims, 20 Drawing Sheets

(58) Field of Classification Search
USPC ..... 73/40.5 R
See application file for complete search history.

(56) References Cited

U.S. PATENT DOCUMENTS

| | | | |
|---|---|---|---|
| 11,525,764 | B2 | 12/2022 | Bryning |
| 11,630,022 | B2 | 4/2023 | Hedberg |
| 2011/0285822 | A1 | 11/2011 | Dai |
| 2012/0265479 | A1 | 10/2012 | Bridges |
| 2014/0067919 | A1 | 3/2014 | Tada |
| 2014/0088442 | A1 | 3/2014 | Soykan |
| 2014/0300886 | A1 | 10/2014 | Zogg |
| 2015/0103178 | A1 | 4/2015 | Itoh |
| 2015/0172545 | A1 | 6/2015 | Szabo |
| 2015/0213697 | A1 | 7/2015 | Knox |
| 2015/0369730 | A1 | 12/2015 | Schmidt |
| 2016/0146696 | A1 | 5/2016 | Steele |
| 2017/0024642 | A1 | 1/2017 | Xiong |
| 2017/0364818 | A1 | 12/2017 | Wu |
| 2018/0039885 | A1 | 2/2018 | Albrecht |
| 2018/0218095 | A1 | 8/2018 | Basu |
| 2018/0292286 | A1 | 10/2018 | Dittberner |
| 2018/0365522 | A1 | 12/2018 | Jiang |
| 2019/0068879 | A1 | 2/2019 | Bao |
| 2019/0196892 | A1 | 6/2019 | Matei |
| 2019/0285504 | A1 | 9/2019 | Muralidhar et al. |
| 2019/0285600 | A1 | 9/2019 | Klein |
| 2019/0302013 | A1 | 10/2019 | Wang |
| 2019/0333266 | A1 | 10/2019 | O'Brien |
| 2019/0340914 | A1 | 11/2019 | Israelsen |
| 2020/0011789 | A1 | 1/2020 | Sandsten |
| 2020/0116583 | A1 | 4/2020 | Hedberg |
| 2020/0176088 | A1 | 6/2020 | Kanamarlapudi |
| 2020/0182779 | A1 | 6/2020 | Kasten |
| 2020/0182780 | A1 | 6/2020 | Kasten |
| 2020/0226426 | A1 | 7/2020 | Jarquin Arroyo |
| 2020/0393434 | A1* | 12/2020 | Li ..... G01N 1/2273 |
| 2020/0398959 | A1 | 12/2020 | Pomerantz et al. |
| 2021/0140934 | A1 | 5/2021 | Smith |
| 2021/0156793 | A1 | 5/2021 | Leen |
| 2021/0255157 | A1 | 8/2021 | Rashid |
| 2022/0244127 | A1 | 8/2022 | Aubrey |
| 2022/0327708 | A1 | 10/2022 | Satish |
| 2023/0111401 | A1 | 4/2023 | Machover |
| 2023/0169222 | A1 | 6/2023 | Wang |
| 2023/0175914 | A1 | 6/2023 | Diven |
| 2023/0177726 | A1 | 6/2023 | Spears |
| 2023/0194483 | A1 | 6/2023 | Some |
| 2023/0222271 | A1 | 7/2023 | Spackova |
| 2023/0304982 | A1 | 9/2023 | Eichenlaub |
| 2023/0324430 | A1 | 10/2023 | Reed |
| 2023/0326201 | A1 | 10/2023 | Rashid |
| 2024/0200991 | A1 | 6/2024 | Salman |
| 2024/0418693 | A1 | 12/2024 | Rashid et al. |
| 2024/0420311 | A1 | 12/2024 | Speck |
| 2025/0044176 | A1 | 2/2025 | Mikhailov |
| 2025/0067858 | A1 | 2/2025 | Boucher |
| 2025/0078240 | A1 | 3/2025 | Zielinski |
| 2025/0110007 | A1 | 4/2025 | Rashid |

FOREIGN PATENT DOCUMENTS

| | | | | |
|---|---|---|---|---|
| CN | 108731645 | A | 11/2018 | |
| CN | 109195132 | A | 1/2019 | |
| CN | 109614526 | A * | 4/2019 | ..... G06Q 10/0639 |
| CN | 111325801 | A | 6/2020 | |
| CN | 113887044 | A | 1/2022 | |
| CN | 114329245 | A | 4/2022 | |
| CN | 114416692 | A | 4/2022 | |
| CN | 115018327 | A | 9/2022 | |
| CN | 115187767 | A | 10/2022 | |
| EP | 0943085 | B1 | 3/2004 | |
| EP | 2329289 | B1 | 9/2013 | |
| JP | H06294500 | A | 10/1994 | |
| JP | H07083786 | A | 3/1995 | |
| JP | H07140031 | A | 6/1995 | |
| JP | H07190879 | A | 7/1995 | |
| JP | H07198523 | A | 8/1995 | |
| JP | 2996349 | B2 | 12/1999 | |
| KR | 101473956 | B1 | 12/2014 | |
| KR | 2015003470 | A | 1/2015 | |
| KR | 1020160123467 | A | 10/2016 | |
| KR | 20180041828 | A | 4/2018 | |
| KR | 1020190058230 | A | 5/2019 | |
| KR | 102482129 | B1 | 1/2023 | |
| WO | 2019213280 | A1 | 11/2019 | |
| WO | 2020018867 | A1 | 1/2020 | |
| WO | 2020206008 | A1 | 10/2020 | |
| WO | WO-2020263693 | A1 * | 12/2020 | ..... F02D 41/22 |
| WO | 2021067844 | A1 | 4/2021 | |
| WO | 2021156864 | A1 | 8/2021 | |
| WO | 2022023226 | A1 | 2/2022 | |
| WO | 2022051572 | A1 | 3/2022 | |
| WO | 2022056152 | A1 | 3/2022 | |
| WO | 2022081717 | A1 | 4/2022 | |
| WO | 2023108041 | A1 | 6/2023 | |
| WO | 2023133345 | A1 | 7/2023 | |
| WO | 2024030523 | A1 | 2/2024 | |
| WO | 2024030525 | A1 | 2/2024 | |
| WO | 2024054640 | A1 | 3/2024 | |
| WO | 2024064113 | A1 | 3/2024 | |
| WO | 2024155857 | A1 | 7/2024 | |
| WO | 2024254521 | A1 | 12/2024 | |

OTHER PUBLICATIONS

Saunois, M., et al. (2020), The Global Methane Budget 2000-2017, Earth Syst. Sci. Data, 12, 1561-1623.

Pomerantz A.E. et al., 2022. Present global warming: a justifiable and stable metric for evaluating short-lived climate pollutants. Environmental Research Letters, 17(11), p. 114052. (6 pages).

Cusworth , D.H. et al., 2021. Intermittency of large methane emitters in the Permian Basin. Environmental Science Technology Letters, 8(7), pp. 567-573.

Chakrabarti et al., Sep. 2022. Rapid Detection of Super-Emitters Utilizing an IoT-Enabled Continuous Methane Emissions Monitoring System. In SPE Annual Technical Conference and Exhibition. OnePetro. (6 pages).

Chakrabarti et al., Oct. 2022. Rapid Detection of Methane Super-Emitters Through Advanced Interpretation. In ADIPEC. OnePetro (6 pages).

Potyrailo, R.A. et al., 2020. Extraordinary performance of semiconducting metal oxide gas sensors using dielectric excitation. Nature Electronics, 3(5), pp. 280-289.

Zimmerle, D. METEC Controlled Test Protocol: Continuous Monitoring Emission Detection And Quantification, Energy Institute, Colorado State University. https://energy.colostate.edu/wp-content/uploads/sites/28/2021/03/Continuous-Monitoring-Protocol-R1.0.pdf (31 pages).

Take control of your emissions management programme, downloaded on Dec. 15, 2023 from link https://sensorup.com/methane-emissions-management/ (12 pages).

BlueSky resources makes sense out of sensors, downloaded on Dec. 15, 2023 from linke https://blueskyresources.com/solutions/ (3 pages).

Majumder et al., "Development and Evaluation of Ensemble Learning-based Environmental Methane Detection and Intensity Prediction Models", Dec. 17, 2023, pp. 1-16 (Year: 2023).

Andrews et al., "Quantitative Mapping of Methane Emissions in Oil Gas Facilities", Oct. 16-18, 2023, Society of Petroleum engineers, SPE-214909-MS, pp. 1-10 (Year: 2023).

Imbiriba et al., "Augmented physics-based machine learning for navigation and tracking", 2023, IEEE Transactions on Aerospace and Electronic Systems, pp. 1-13 (Year: 2023).

S. R. Hanna, G. A. Briggs, R. P. Hosker, 1982, Handbook on Atmospheric Diffusion, DOE/TIC-11223 (7 pages).

"AERMOD" downloaded from Wikipedia on Jul. 31, 2024 from [https://en.wikipedia.org/wiki/AERMOD], Last Edited Mar. 4, 2022, 2 pages.

(56) References Cited

OTHER PUBLICATIONS

Search Report issued in Norwegian U.S. Appl. No. 20/230,720 on Jan. 23, 2024; 10 pages.
Combined Search and Exam Report issued in United Kingdom patent Application No. GB2409015.1 dated Oct. 8, 2024, 5 pages.
Examination Report issued in Norwegian Patent Application No. 20230720 issued on Dec. 19, 2024, 1 page.
Office Action issued in U.S. Appl. No. 18/480,279 dated Nov. 7, 2023, 13 pages.
Notice of Allowance issued in U.S. Appl. No. 18/480,279 dated Nov. 8, 2024, 26 pages.
Extended Search Report issued in European Patent Application No. 24182656.9 dated Nov. 14, 2024, 6 pages.
International Search Report and Written Opinion issued in the PCT Application No. PCT/US2024/033102 dated Sep. 24, 2024, 10 pages.
Office Action issued in U.S. Appl. No. 18/537,978 dated Mar. 7, 2024, 10 pages.
International Search Report and Written Opinion issued in PCT Application PCT/US2023/083724, dated Apr. 30, 2024 (9 pages).
Notice of Allowance issued in U.S. Appl. No. 18/537,978 dated Aug. 19, 2024, 10 pages.
Notice of Allowance issued in U.S. Appl. No. 18/537,978 dated Jan. 27, 2025, 16 pages.
Extended Search Report issued in United Kingdom Patent Application No. GB2412830.8 dated Jan. 29, 2025, 7 pages.
International Search Report and Written Opinion issued in PCT Application PCT/US2023/033106, dated Jan. 23, 2024 (7 pages).
International Preliminary Report on Patentability issued in the PCT Application No. PCT/US2023/029361 dated Feb. 13, 2025, 7 pages.
International Search Report and Written Opinion issued in the PCT Application No. PCT/US2023/029363 dated Nov. 21, 2023, 10 pages.
International Preliminary Report on Patentability issued in the PCT Appliction No. PCT/US2023/029363 dated Feb. 13, 2025, 6 pages.
International Search Report and Written Opinion issued in the PCT Application No. PCT/US2024/012087 dated May 23, 2024, 11 pages.
International Search Report and Written Opinion issued in PCT Application PCT/US2023/010475, dated May 2, 2023 (11 pages).
International Preliminary Report on Patentability issued in the PCT Application No. PCT/US2023/010475 dated Jul. 25, 2024, 8 pages.
International Search Report and Written Opinion issued in PCT Application PCT/US2023/032307, dated Dec. 26, 2023 (10 pages).
International Search Report and Written Opinion of International Patent Application No. PCT/US2023/029361 dated on Nov. 14, 2023, 11 pages.
Yu, L et al., "Methane Leakage Source Location Based On a Near-Infrared Off-Axis Integrated Cavity Output Spectroscopic ppbv-Level Sensor and An Optimized Inverse Model", Infrared Physics & Technology, 2022, vol. 121, 9 Pages.
Weidmann, D. et al., "Locating And Quantifying Methane Emissions by Inverse Analysis Of Path-Integrated Concentration Data Using a Markov-Chain Monte Carlo Approach", ACS Earth and Space Chemistry, 2022, pp. 2190-2198, 6(9).
Ye, W. et al., "Leakage Source Location Based On Gaussian Plume Diffusion Model Using A Near-Infrared Sensor", Infrared Physics & Technology, Sep. 2020, pp. 1-5, vol. 109.
Montazeri, A. et al., "On the Viability of Video Imaging in Leak Rate Quantification: A Theoretical Error Analysis", Sensors (Basel), Aug. 24, 2021; 21 (17):5683. doi: 10.3390/s21175683. PMID: 34502574; PMCID: PMC8434307 (Year: 2021).
Hirst, B. et al., "Locating and quantifying gas emission sources using remotely obtained concentration data", arXiv preprint of Atmospheric Environment, 2013, vol. 74, pp. 141-158.

* cited by examiner $$\text{MIN } f(X) = \sqrt{\frac{1}{R}\sum_{i=1}^{R}\left(M_i^{obs} - M_i^{pred}(X \mid W_i\, U_i)\right)^2}$$

$$\text{S.T.} \quad G(X) \leq 0$$

$$x_L \leq x_i \leq x_u$$

$$X \in R^n \quad (X \in Z^n)$$

$$M^{pred} = \text{plume}(X \mid W, U)$$

$$X = [\, Source_x\ Source_y\ Source_x\ Source_r \,]$$

$$W = [\, wind_{dif}\ wind_{speed}\ Source_{stability} \,]$$

$$U = [\, Sensor_x\ Sensor_y\ Sensor_Z \,]$$

$$REC_i = [\, W\ U\ M^{obs} \,]_i$$

FIG. 1

Number of Samples (N)
Number of Active Samples (Nact)
Active Sample Ratio (Nact / N)
Average Active Concentration (Ppm)
Max Concentration (Ppm)

LINEAR CUT GENERATION METHOD FOR SENSOR INVERSION CONSTRAINT IMPOSITION

CROSS-REFERENCE TO RELATED APPLICATIONS

The present patent application is the National Stage Entry of International Application No. PCT/US2023/029361, filed Aug. 3, 2023, which claims priority to U.S. Provisional Patent Application No. 63/370,285, filed Aug. 3, 2022, which is herein incorporated by reference in its entirety.

FIELD OF THE DISCLOSURE

Aspects of the disclosure relate to identification of source contaminants in a field. More specifically, aspects of the disclosure relate to providing a linear cut evaluation method to help identify and quantify methane leakage into an environment.

BACKGROUND

Quantification of environmental contaminants in the environment is becoming more important as companies and nations seek to cut air pollution. Historically, methane leaks were allowed in oil field service operations as remediation of these leaks could be economically costly.

With the advent of attempts to curb greenhouse gas emissions, methane has come under increasingly stringent review. Current methods for identification of methane leaks are based upon conventional fluid dynamics equations. Unfortunately, placements of sensors, variability of environmental conditions and other constraints hinder the overall ability of operators to identify and quantify methane leaks in the field to levels currently desired.

There is a need to provide an apparatus and methods that are easier to operate than conventional apparatus and methods for quantification and characterization of methane leaks in the environment.

There is a still further need to reduce economic costs associated with operations and apparatus for quantification of methane leaks pertaining to conventional tools and methods.

SUMMARY

So that the manner in which the above recited features of the present disclosure can be understood in detail, a more particular description of the disclosure, briefly summarized below, may be had by reference to embodiments, some of which are illustrated in the drawings. It is to be noted that the drawings illustrate only typical embodiments of this disclosure and are therefore not to be considered limiting of its scope, for the disclosure may admit to other equally effective embodiments without specific recitation. Accordingly, the following summary provides just a few aspects of the description and should not be used to limit the described embodiments to a single concept.

In one example embodiment, a method for evaluating the presence of a methane leak is disclosed. The method may comprise performing a record generation event and performing a quality assessment of the record generation event. The method may also comprise performing a linear cut generation of the record generation event after the quality assessment to create a linear cut generation data set. The method may further comprise performing a source term inversion subject to the linear cut generation data set.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the drawings. It is to be noted, however, that the appended drawings illustrate only typical embodiments of this disclosure and are therefore not to be considered limiting of its scope, for the disclosure may admit to other equally effective embodiments.

FIG. 1 is a depiction of a mathematical model for an inversion procedure for data, in one example embodiment of the disclosure.

Figure 2:
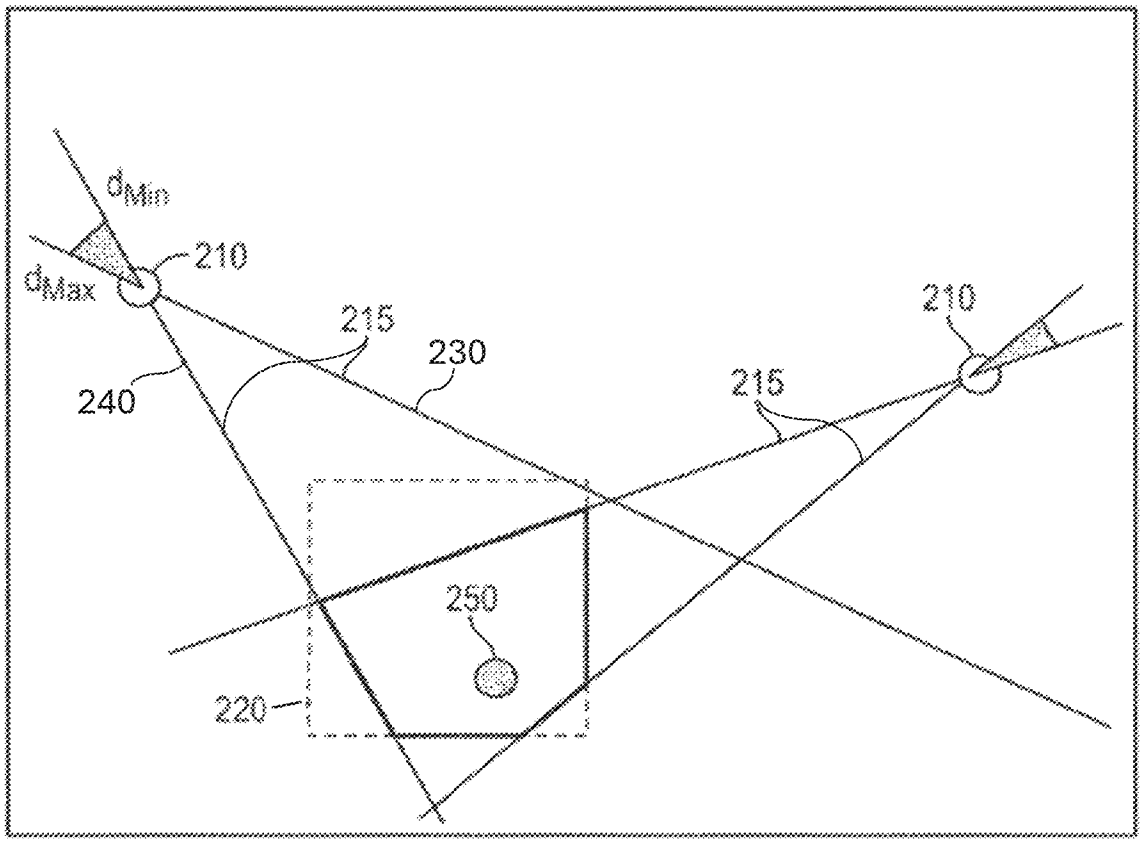
FIG. 2 is a high-level cone generation schema in one example embodiment of the disclosure.
Figure 2:
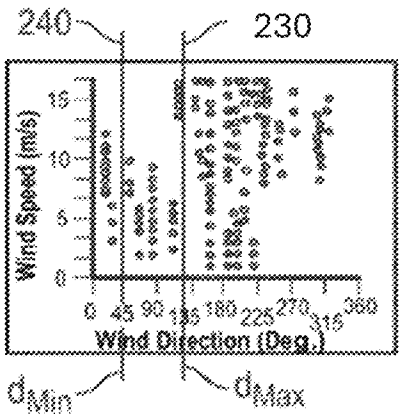

To facilitate understanding, identical reference numerals have been used, where possible, to designate identical elements that are common to the figures ("FIGS"). It is contemplated that elements disclosed in one embodiment may be beneficially utilized on other embodiments without specific recitation.

DETAILED DESCRIPTION

In the following, reference is made to embodiments of the disclosure. It should be understood, however, that the disclosure is not limited to specific described embodiments. Instead, any combination of the following features and elements, whether related to different embodiments or not, is contemplated to implement and practice the disclosure. Furthermore, although embodiments of the disclosure may achieve advantages over other possible solutions and/or over the prior art, whether or not a particular advantage is achieved by a given embodiment is not limiting of the disclosure. Thus, the following aspects, features, embodiments and advantages are merely illustrative and are not considered elements or limitations of the claims except where explicitly recited in a claim. Likewise, reference to "the disclosure" shall not be construed as a generalization of inventive subject matter disclosed herein and should not be considered to be an element or limitation of the claims except where explicitly recited in a claim.

Although the terms first, second, third, etc., may be used herein to describe various elements, components, regions, layers and/or sections, these elements, components, regions, layers and/or sections should not be limited by these terms. These terms may be only used to distinguish one element, components, region, layer or section from another region, layer or section. Terms such as "first", "second" and other numerical terms, when used herein, do not imply a sequence or order unless clearly indicated by the context. Thus, a first element, component, region, layer or section discussed herein could be termed a second element, component, region, layer or section without departing from the teachings of the example embodiments.

When an element or layer is referred to as being "on," "engaged to," "connected to," or "coupled to" another element or layer, it may be directly on, engaged, connected, coupled to the other element or layer, or interleaving elements or layers may be present. In contrast, when an element is referred to as being "directly on," "directly engaged to," "directly connected to," or "directly coupled to" another element or layer, there may be no interleaving elements or layers present. Other words used to describe the relationship between elements should be interpreted in a like fashion. As used herein, the term "and/or" includes any and all combinations of one or more of the associated listed terms.

Some embodiments will now be described with reference to the figures. Like elements in the various figures will be referenced with like numbers for consistency. In the following description, numerous details are set forth to provide an understanding of various embodiments and/or features. It will be understood, however, by those skilled in the art, that some embodiments may be practiced without many of these details, and that numerous variations or modifications from the described embodiments are possible. As used herein, the terms "above" and "below", "up" and "down", "upper" and "lower", "upwardly" and "downwardly", and other like terms indicating relative positions above or below a given point are used in this description to more clearly describe certain embodiments.

Aspects of the disclosure provide a procedure to identify a set of linear cuts that may be included in the methane sensor-inversion problem to improve the efficiency of the search. In particular, two linear cuts may be generated for each fixed sensor given the available wind and concentration measurement readings taken. The extraction of valid linear cuts for a given sensor identifies a cone indicative of the anticipated leak source direction. Thus, a collection of linear cuts may serve to identify a feasible sub-space in which the leak source may reside. Mathematically, this yields a set of linear constraints that are subsequently included in the inversion step. Embodiments provided herein describe the linear cut procedure and its use in the sensor-inversion procedure.

The sensor inversion procedure is based on the following steps for a given collection of data from a given time (T=0) that is repeated periodically, perhaps, every hour:

1—Record Generation

2—Record Quality Assessment

3—Linear Cut Generation

4—Source Term Inversion

Wait for given period and then repeat.

The key assumptions are that a number of fixed methane sensors are deployed on a given site with known boundary conditions and possibly, other information pertinent to the facility layout, including the location of equipment prone to leak.

An anemometer is used to record the incumbent wind conditions (e.g., the wind speed and direction). The weather conditions (e.g., the solar intensity and cloud cover) are also recorded as these are required for the wind stability class estimation.

A simple Gaussian plume model is employed as the forward predictive model. A leak will result in a significant concentration reading at one or more sensors. The inversion process concerns identification of the source location and rate.

Details of the record generation and inversion procedure are known in the industry. A root mean square error (RMSE) measure is used when all records are employed with equal weighting, but a weighted mean square error measure (WMSE) is used if the records are assigned weights based on a quality measure in Step 2. Generally, the procedure is robust to mitigate against undesirable and unattainable records. The mathematical model is shown in FIG. 1. Aspects of the disclosure outline a method and procedure of step 3 (and its impact on step 4).

FIG. 1—Inversion Problem Definition

Referring to FIG. 1, the error measure concerns minimization of the sum of residuals for each record in the collection, of size R. X defines the set of control variables (the source location and rate), while W is the wind condition and U is the sensor information associated with each record, with noted observation $M^{obs}$. The variables are specified within given bounds, and may be continuous or discrete depending on need. G(X) defines the set of constraints if valid linear cuts are generated and employed as part of the inversion procedure.

The high-level cone generation schema is shown in FIG. 2. The inset plot (top left) displays the wind-sensor data for a given sensor 210 (shown in the main plan view). The inset plot shows active readings (readings between $d_{min}$ reference line 240 and $d_{max}$ reference line 230 where concentration level is significant and inactive readings (readings outside of $d_{min}$ reference line 240 and $d_{max}$ reference line 230 where concentration level is below the detection threshold of the sensor employed. The minimum and maximum angles of receptivity are identified and marked by angles $d_{min}$ and $d_{max}$, respectively. These markers are used to set the vertical angle at the sensor giving rise to a cone (see 215 on the main plot). Multiple cones from multiple sensors can identify a feasible sub-space (see 220 on the main plot) in which the source 250 may reside. This feasible sub-space 220 is stipulated by the constraint set G (X). The reduced search bounds encasing the convex hull are also returned (not shown in FIG. 2).

FIG. 2—Linear Cut Generation Schema

Referring to FIG. 2, the inset plot shows wind-sensor data for a sensor 210 (shown top left in the main plot). The data is plotted with active readings (readings between $d_{min}$ reference line 240 and $d_{max}$ reference line 230 where a concentration level is significant, and the inactive readings (readings outside of $d_{min}$ reference line 240 and $d_{max}$ reference line 230. The minimum and maximum angles of receptivity at the sensor are marked by $d_{min}$ and $d_{max}$, respectively. These angles are used to mark the vertical angle at the sensor giving a cone. Multiple cones can identify a feasible sub-space (see 220 on the main plot) in which a source 250 may reside.

Single Cone Evaluation

For further processing, a cone generation method is presented herein. The method entails tuning of a set of parameters that determine the minimum permissible size of the cone, the separation angle between multiple possible cones, and tests to isolate the dominant cone based on sample density and concentration, among others. Note that the wind-sensor data is first filtered based on concentration (above minimum detection threshold) and the wind speed (either too low or too high) and is sorted in ascending order of wind direction. This ensures that only suitable samples are retained for cone extraction.

The cone generation parameters are tunable, but robust default settings have been established based on performance over a set of field tests.

The following settings are established and recommended for use: Such values may be altered and should not be considered limiting:

Cone cut active level (15 ppm=3*detection threshold).

Minimum cone width (45 deg)

Minimum cone separation angle (25 deg)

Maximum cone width (180 deg) to prevent reflex angles

Minimum number of active samples ($n_{act}^{min}$=10).

Minimum active sample cone density ($n_{act}$/n=0.19), where n is the number of samples.

Minimum average active cone concentration (20 ppm).

Figure 3A:
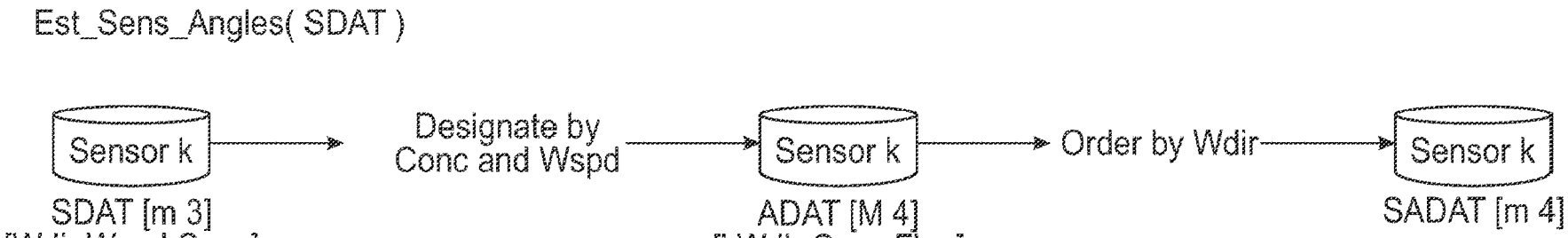
FIG. 3A is a cone generation and data processing sensor step in one example embodiment of the disclosure.

The following figures demonstrate schematically the cone generation procedure. FIG. 3A shows the data processing steps, followed by wedge and cone identification in FIGS. 3B and 3C, respectively. The cone acceptance conditions are given in FIG. 3D if only one valid cone is sought. If appropriate, all the cones can be returned for consideration.

Processing the wind-sensor data for all sensors will yield a set of valid cones, each described by two linear cuts. The collection of linear cuts (as equations) yield the constraint set G(X) along with the reduced bounds [CLB CUB] that can be imposed on the inversion problem as stated in FIG. 1. Here, the reduced bounds may replace the original stipulated bounds for the search, given by [LB UB].

FIG. 3A—Cone Generation—Data Processing

Referring to FIG. 3A, SDAT is the input data for a given sensor comprising wind direction (deg), wind speed (m/s) and concentration (ppm) per row. The data is filtered according to a minimum concentration threshold and a desirable speed range (e.g., [2 8] m/s), giving the array ADAT. This array is sorted by wind direction as SADAT and is used to identify valid cones.

Figure 3B:
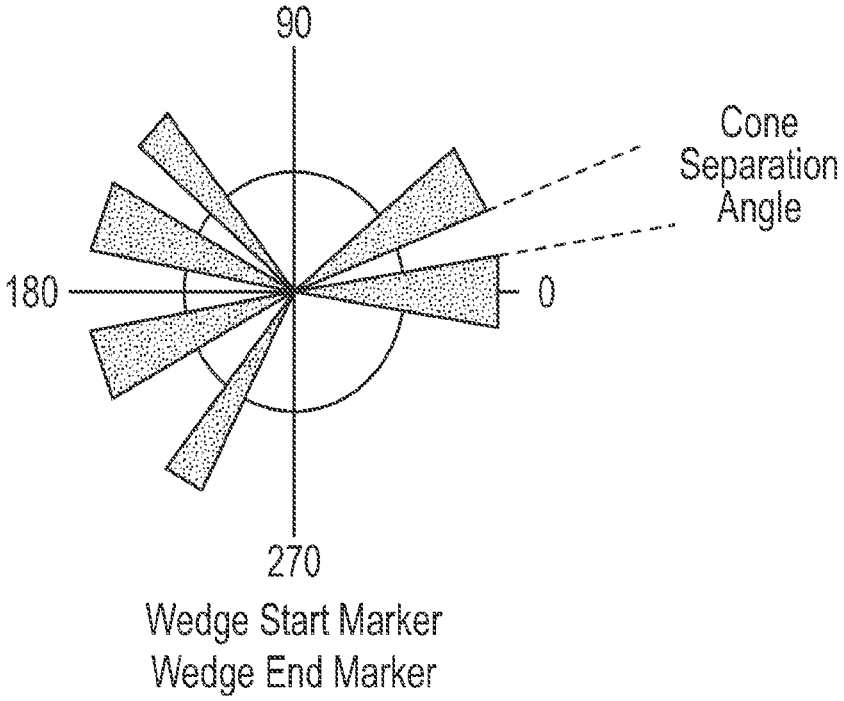
FIG. 3B is a wedge generation processing step in one example embodiment of the disclosure.

FIG. 3B—Cone Generation—Wedge Identification

Referring to FIG. 3B, the data in array SADAT is used to identify wedges, or blocks of data, comprising active concentration measurements and those which do not.

Figure 3C:
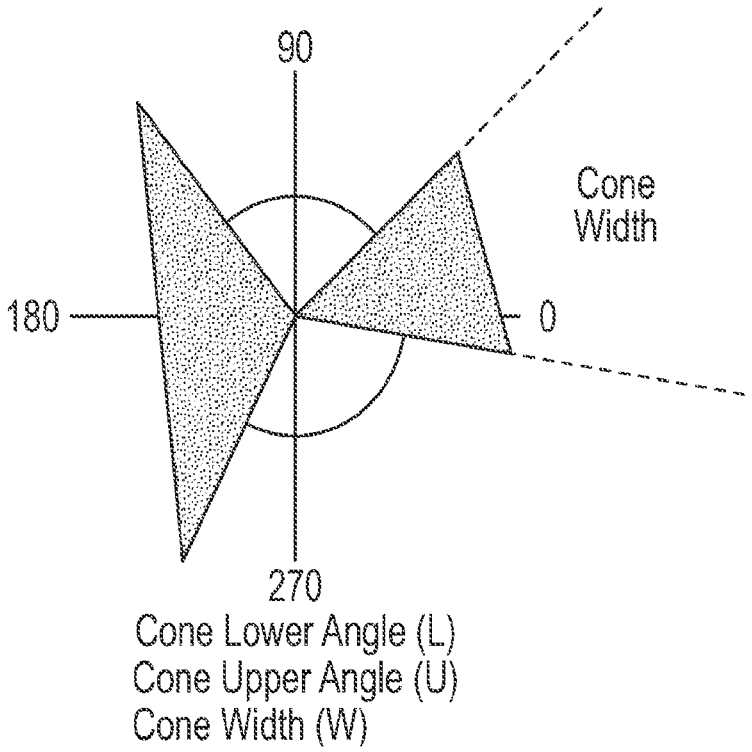
FIG. 3C is a cone identification processing method in one example embodiment of the disclosure.

FIG. 3C—Cone Generation—Cone Identification

Referring to FIG. 3C, a merge wedge flag is assigned based on the gap between wedges. If the gap is less than the minimum cone separation angle, the wedges are merged into a larger cone. The process repeats until only acceptable cones remain.

Figure 3D:
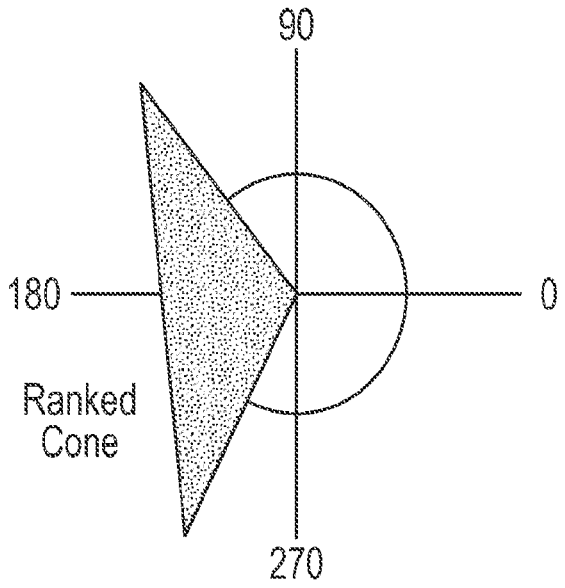
FIG. 3D is a graph of cone generation and acceptance criteria in one example embodiment of the disclosure.

FIG. 3D—Cone Generation—Acceptance Criteria

Referring to FIG. 3D, the cone selection criteria are used to rank and select the major cone of interest. If the stipulated accept conditions are met, a valid cone is returned for the given sensor. The same procedure is applied to each sensor. Note that each cone (with known width and angles [min, middle, max]) yields two linear cuts. These are gathered in the constraint set G(X) for use in the subsequent inversion step.

Example—Case 26 with 6 Sensors

Six sensors are used in this example, with index values [3 14 22 23 24 25]. The cone generation plots are shown in FIGS. 4A to 4F. Each of FIGS. 4A to 4F comprises 3 sub-plots. The top-left plot shows sample index with wind direction. The dots indicate inactive samples, while the circles mark the active samples with concentration levels above the stipulated detection threshold (including the background). A low gradient indicates a faster changing wind direction (less stable), while a higher slope indicates that a greater number of samples are preferentially obtained at a similar wind direction (more stable). If a valid cone is identified, the minimum and maximum receptivity angles are marked by lines 410 and the mid-angle is given by a line 420 (as per the procedure described above). The same information is presented in circular wind direction plot in the top-right. This shows clearly the active samples, the receptivity angles and the shape of the resulting cone. Lastly, the concentration level with wind direction is shown at the bottom.

Figure 4A:
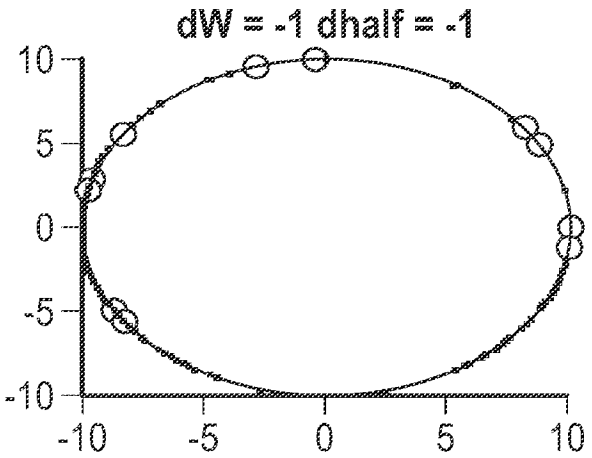
FIG. 4A is a cone generation plot for a sensor 3 in one example embodiment of the disclosure.
Figure 4A:
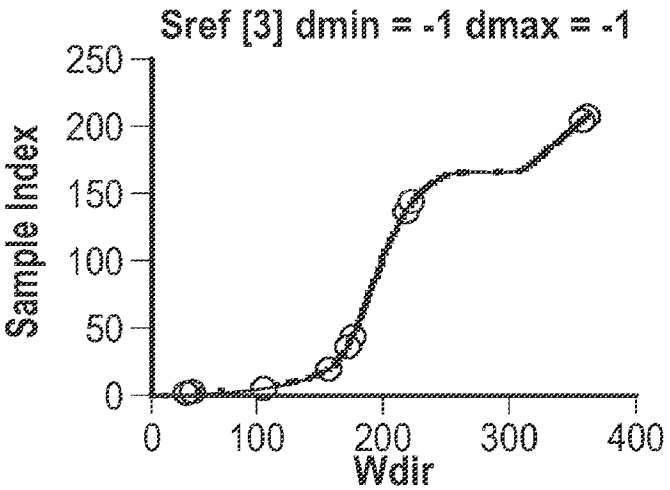
Figure 4A:
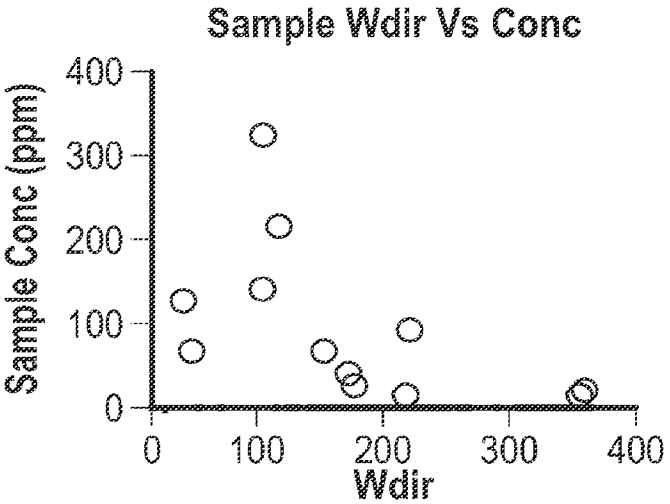
Figure 4B:
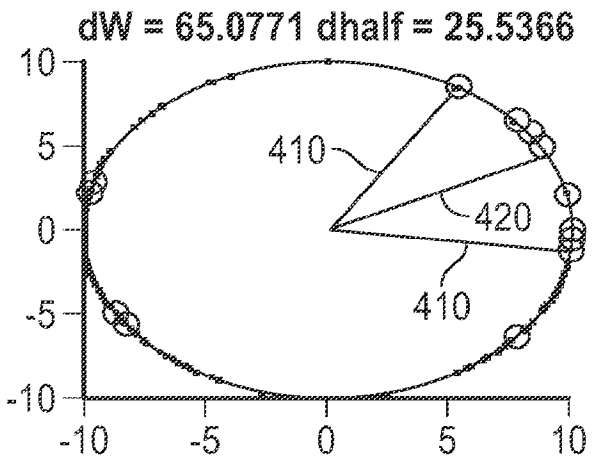
FIG. 4B is a cone generation plot for a sensor 14 in one example embodiment of the disclosure.
Figure 4B:
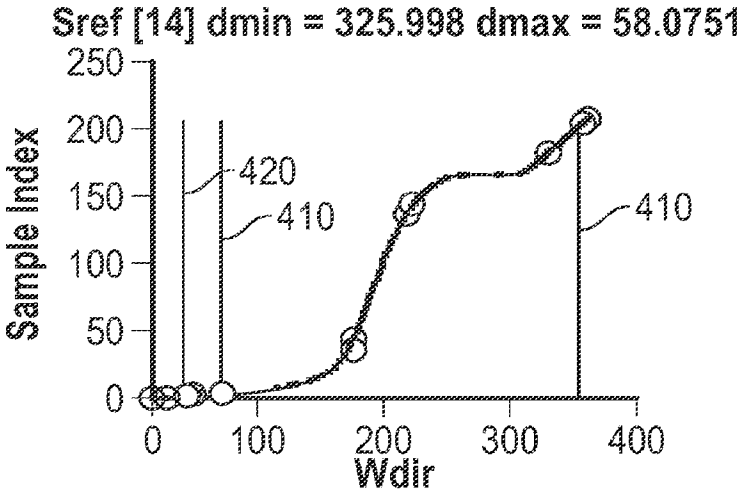
Figure 4B:
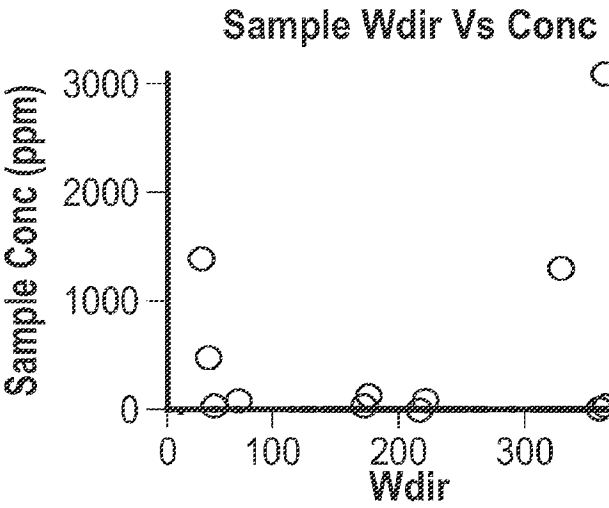
Figure 4C:
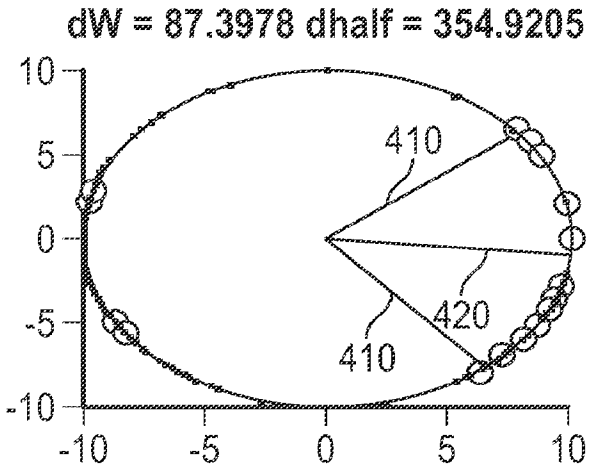
FIG. 4C is a cone generation plot for a sensor 22 in one example embodiment of the disclosure.
Figure 4C:
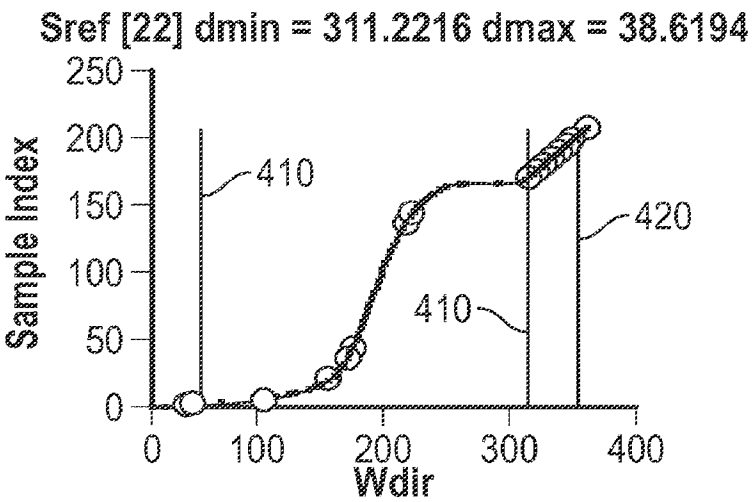
Figure 4C:
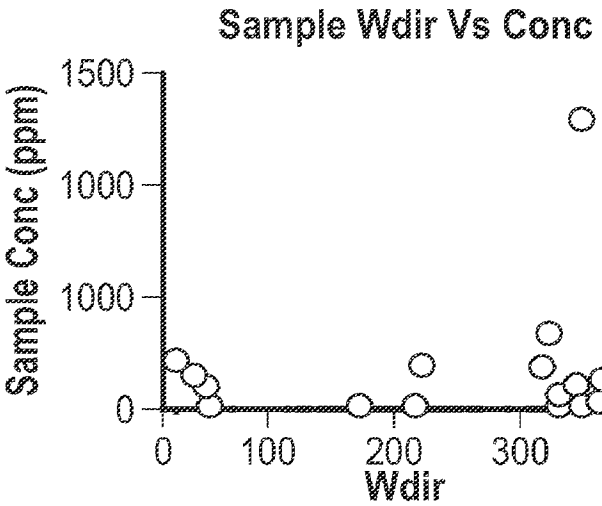
Figure 4D:
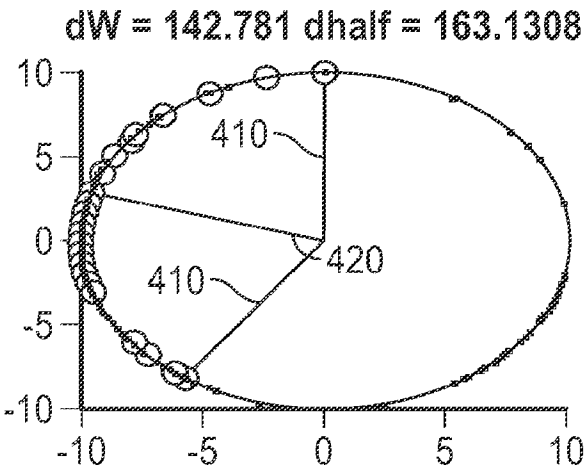
FIG. 4D is a cone generation plot for a sensor 23 in one example embodiment of the disclosure.
Figure 4D:
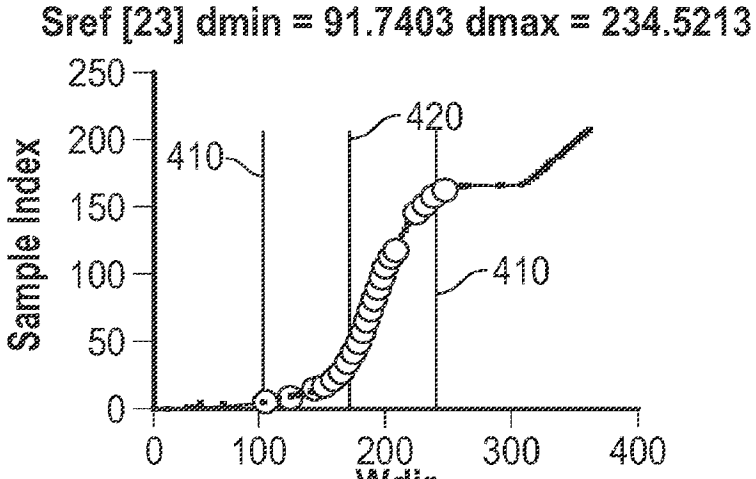
Figure 4D:
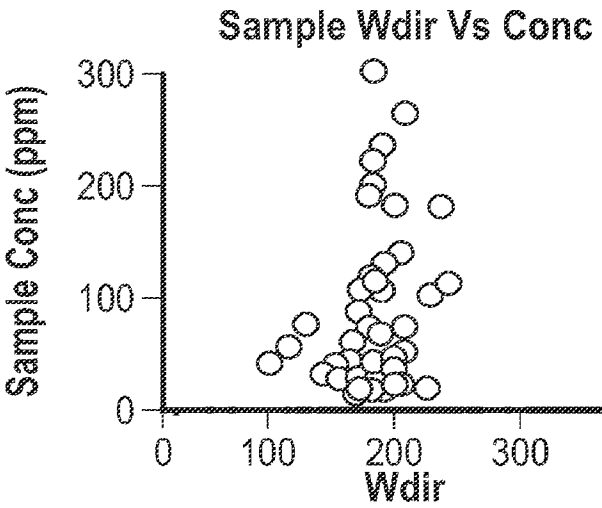
Figure 4E:
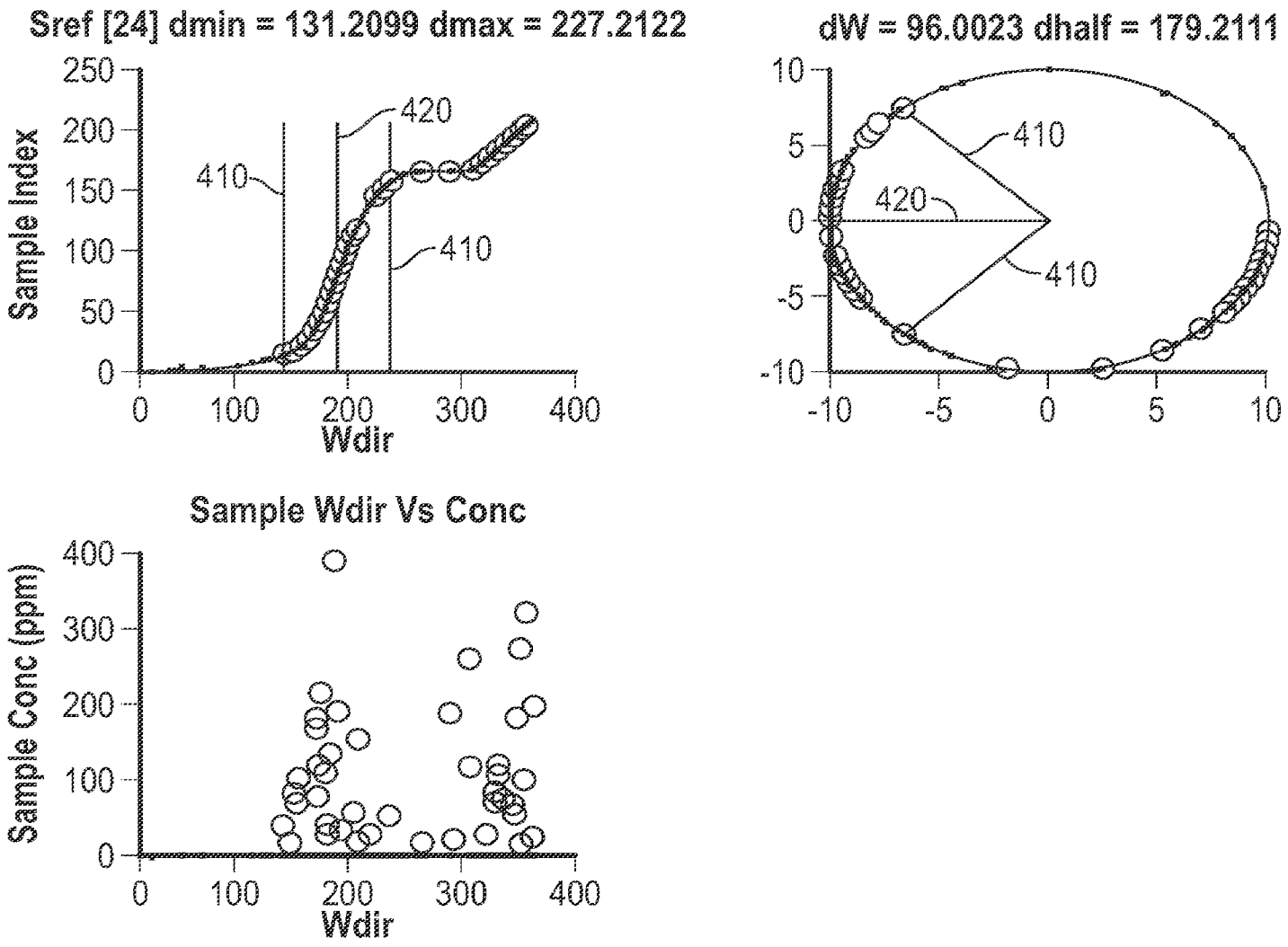
FIG. 4E is a cone generation plot for a sensor 24 in one example embodiment of the disclosure.
Figure 4F:
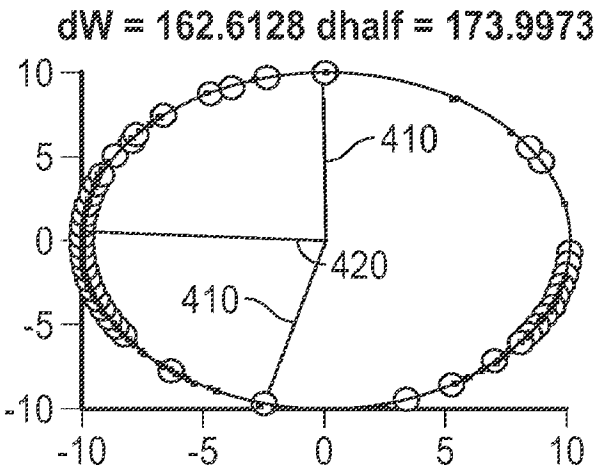
FIG. 4F is a cone generation plot for a sensor 25 in one example embodiment of the disclosure.
Figure 4F:
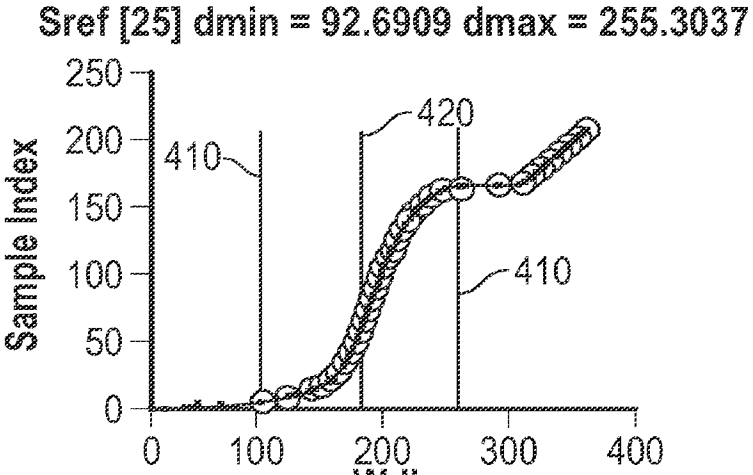
Figure 4F:
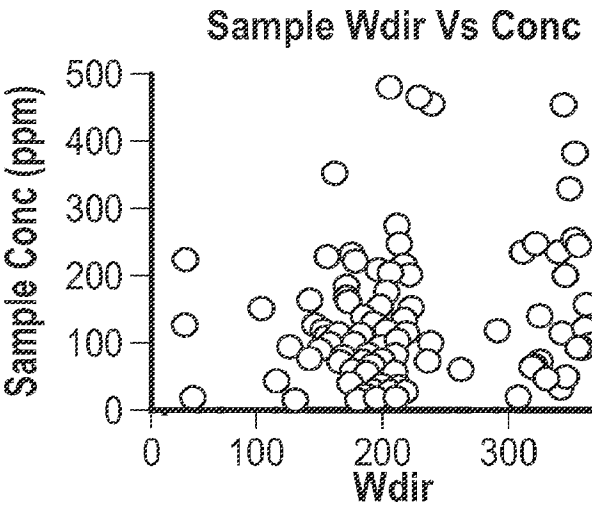
Figure 5A:
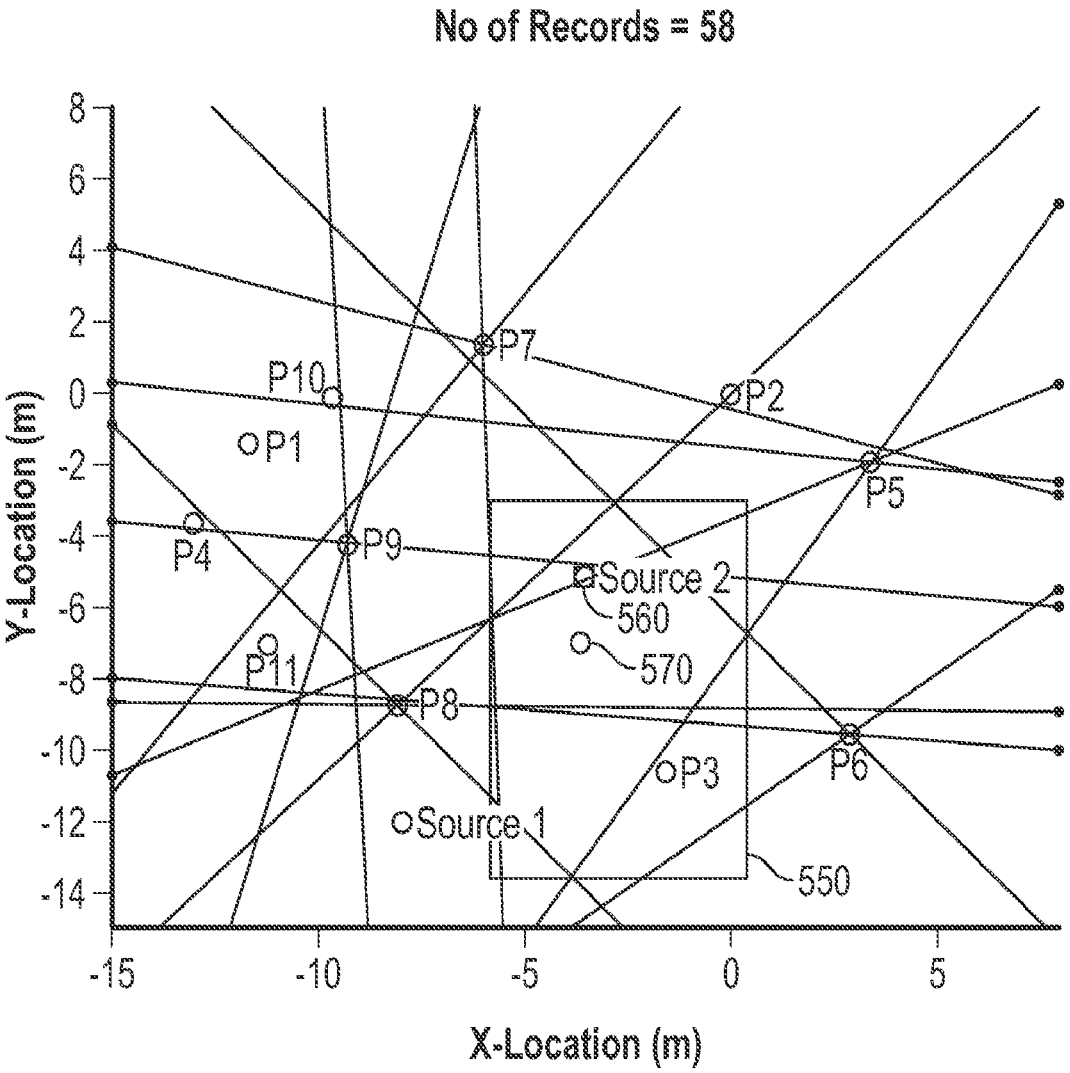
FIG. 5A is a constrained plot plan in x and y coordinates of linear cuts and sub bounds for case 26 in one example embodiment of the disclosure.
Figure 5B:
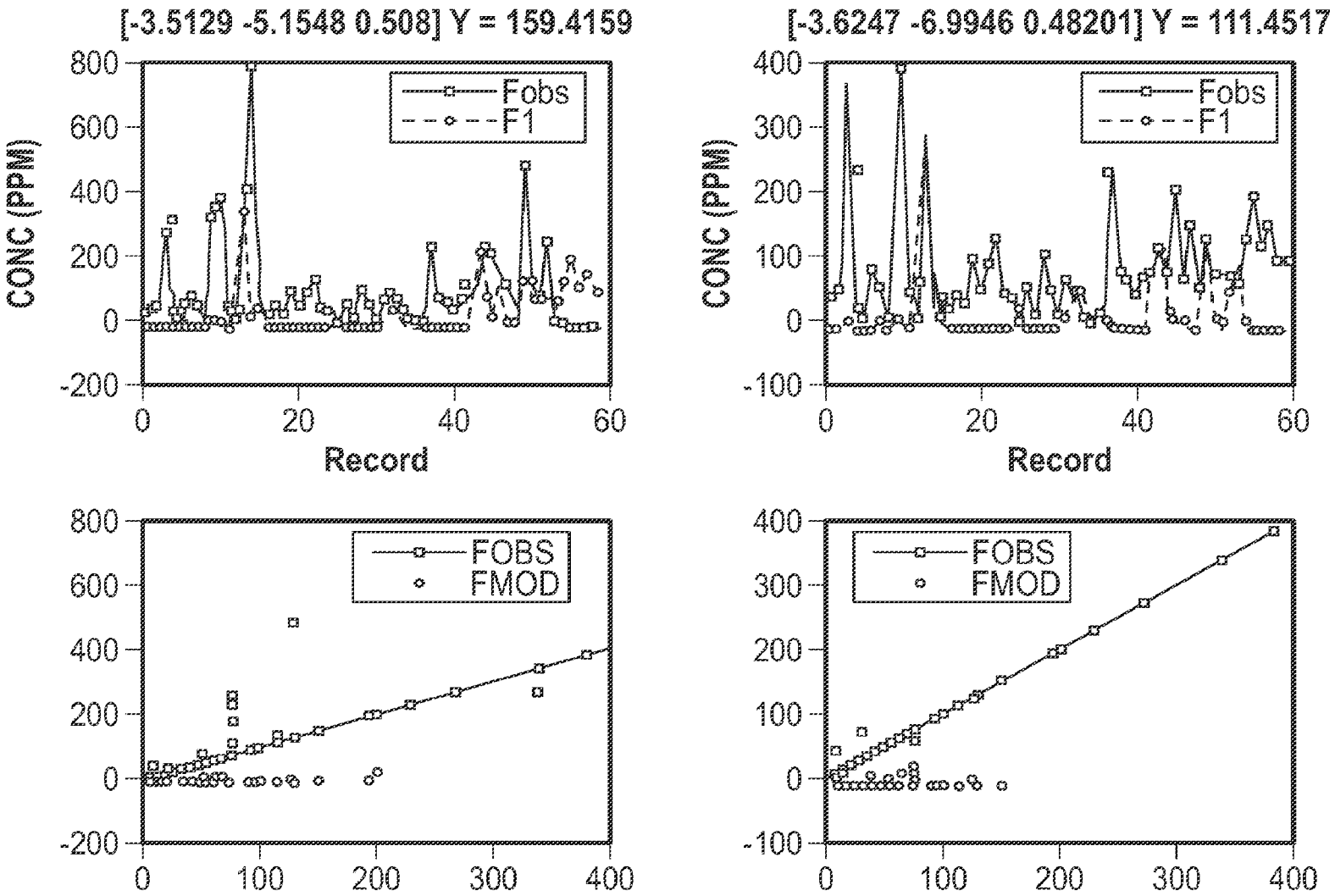
FIG. 5B is a constrained objective evaluation at a known source (left) and at a solution (right) in one example embodiment of the disclosure.

FIGS. 5A and 5B show the constrained case plan view and evaluation plots, respectively. Note that the cones shown in FIGS. 4A to 4F are projected on the plan view using the vertical angle at each sensor. This identifies the feasible sub-space 550. The solution is close to the known source in FIG. 5A.

Figure 6A:
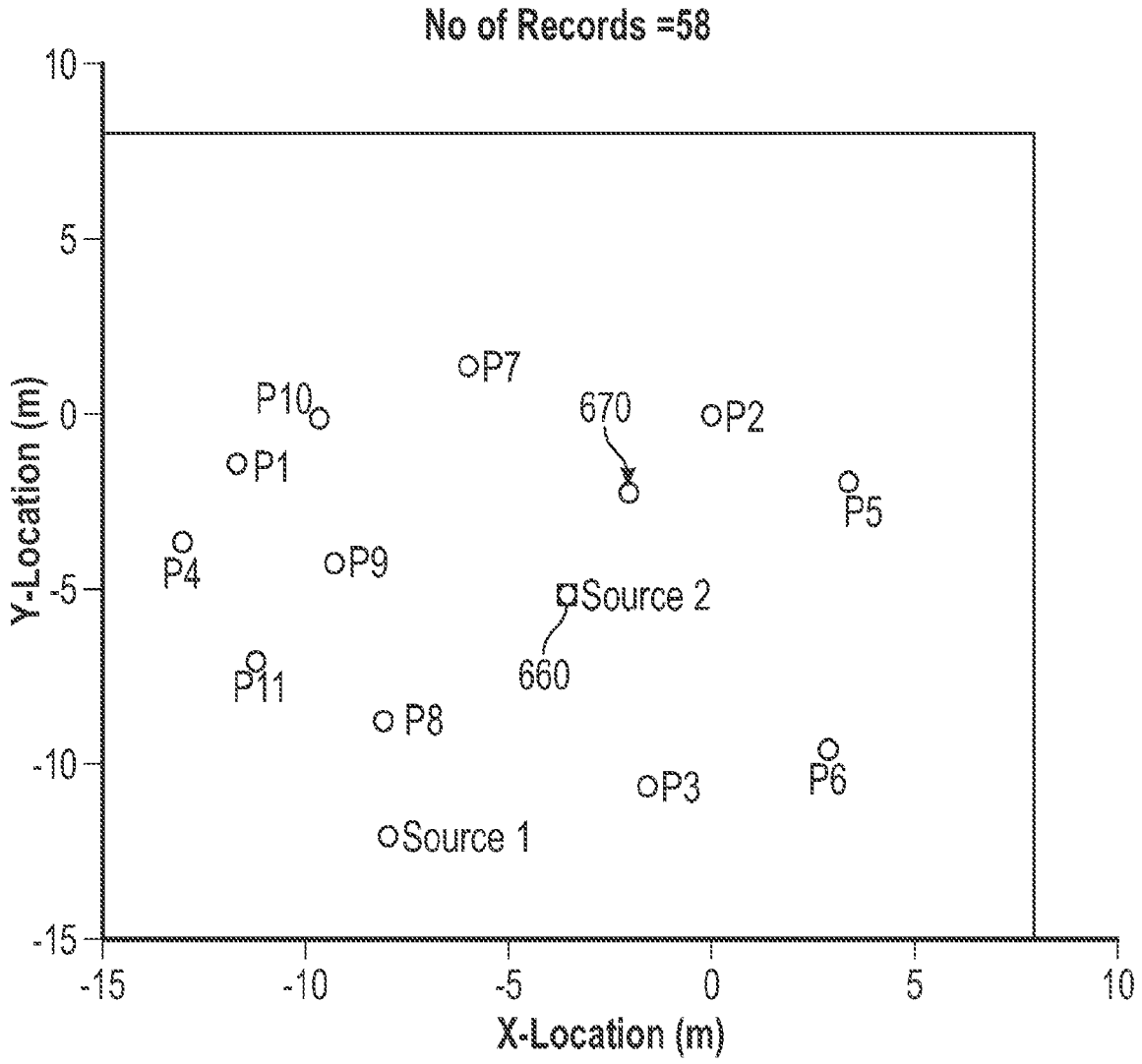
FIG. 6A is a bound constrained plot plan in the x and y axis for case 26.
Figure 6B:
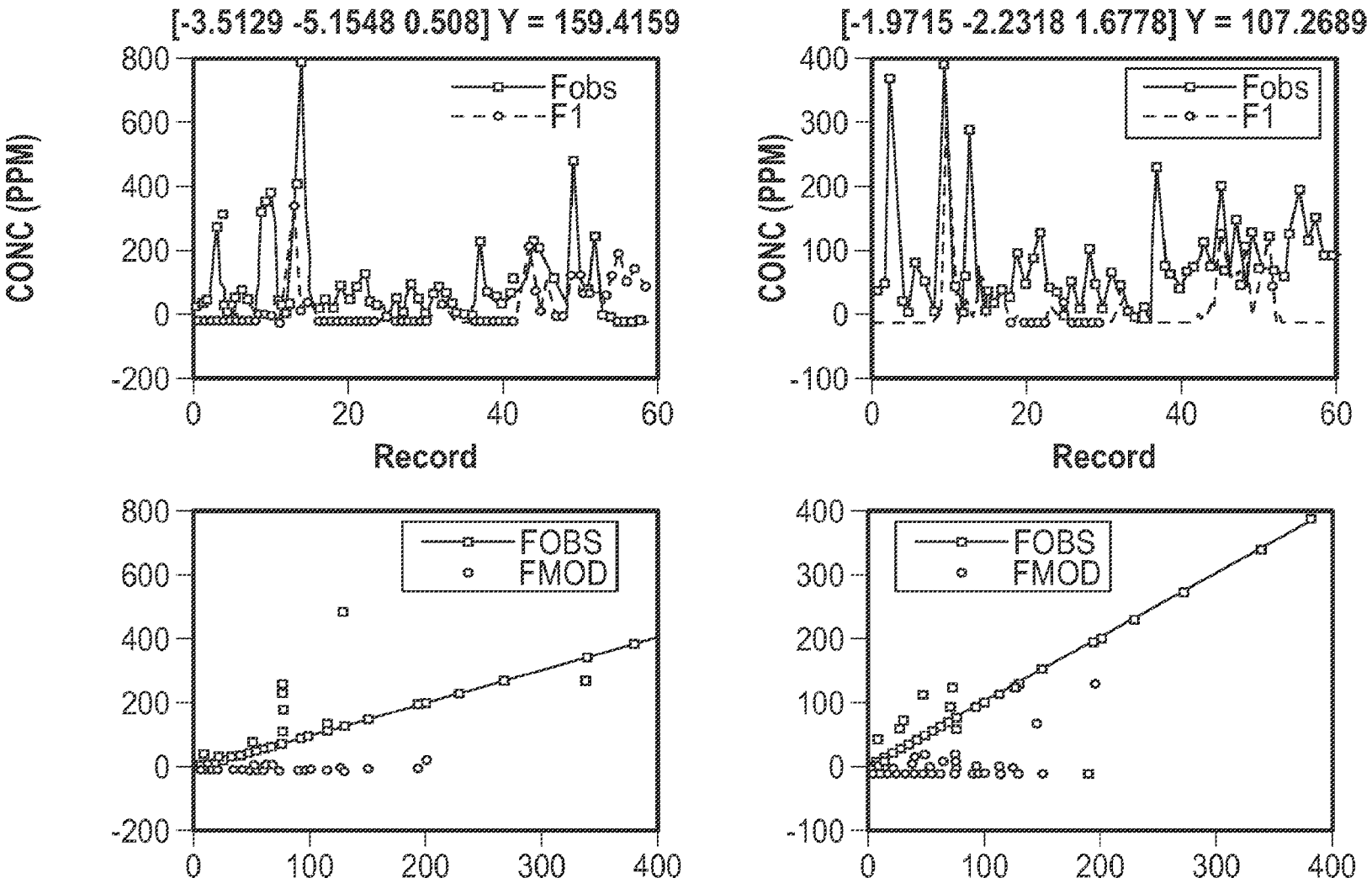
FIG. 6B is a constrained objective evaluation for case 26 at a known source (left) and at a solution (right) in one example embodiment of the disclosure.

The equivalent plots for the unconstrained case (with no cone generation) are shown in FIGS. 6A and 6B, respectively, for comparative purposes. In FIG. 6A, the solution is also near the known source.

FIG. 4A—Cone Generation Plots—Sensor 3 on Pole 2

Referring to FIG. 4A, a cone generation plot for sensor 3 is shown. FIG. 4A illustrates wind direction vs. sample index in the top left plot, circular direction plot in the top right plot, and wind direction vs. concentration (ppm) in the bottom plot. Active samples are depicted with circles and inactive samples are depicted with dots.

FIG. 4B—Cone Generation Plots—Sensor 14 on Pole 5

Referring to FIG. 4B, a cone generation plot for sensor 14 is shown. FIG. 4B illustrates wind direction vs. sample index in the top left plot, circular direction plot in the top right plot, and wind direction vs. concentration (ppm) in the bottom plot. Active samples are depicted with circles, inactive samples are depicted with dots, angles ($d_{min}$ and $d_{max}$) are shown by reference line 410, and the mid-angle is shown by reference line 420.

FIG. 4C—Cone Generation Plots—Sensor 22 on Pole 6

Referring to FIG. 4C, a cone generation plot for sensor 22 is shown. FIG. 4C illustrates wind direction vs. sample index in the top left plot, circular direction plot in the top right plot, and wind direction vs. concentration (ppm) in the bottom plot. Active samples are depicted with circles, inactive samples are depicted with dots, angles ($d_{min}$ and $d_{max}$) are shown by reference line 410, and the mid-angle is shown by reference line 420.

FIG. 4D—Cone Generation Plots—Sensor 23 on Pole 7

Referring to FIG. 4D, a cone generation plot for sensor 23 is shown. FIG. 4D illustrates wind direction vs. sample index in the top left plot, circular direction plot in the top right plot, and wind direction vs. concentration (ppm) in the bottom plot. Active samples are depicted with circles, inactive samples are depicted with dots, angles ($d_{min}$ and $d_{max}$) are shown by reference line 410, and the mid-angle is shown by reference line 420.

FIG. 4E—Cone Generation Plots—Sensor 24 on Pole 8

Referring to FIG. 4E, a cone generation plot for sensor 24 is shown. FIG. 4E illustrates wind direction vs. sample index in the top left plot, circular direction plot in the top right plot, and wind direction vs. concentration (ppm) in the bottom plot. Active samples are depicted with circles, inactive samples are depicted with dots, angles ($d_{min}$ and $d_{max}$) are shown by reference line 410, and the mid-angle is shown by reference line 420.

FIG. 4F—Cone Generation Plots—Sensor 25 on Pole 9

Referring to FIG. 4F, a cone generation plot for sensor 25 is shown. FIG. 4F illustrates wind direction vs. sample index in the top left plot, circular direction plot in the top right plot, and wind direction vs. concentration (ppm) in the bottom plot. Active samples are depicted with circles, inactive samples are depicted with dots, angles ($d_{min}$ and $d_{max}$) are shown by reference line 410, and the mid-angle is shown by reference line 420.

FIG. 5A—Case 26—Constrained—Plan

Referring to FIG. 5A, a constrained plan view with linear cuts, mid-angle, sub-bounds 550 is illustrated for case 26. Potential sources are depicted with a known source 560. The solution is shown by reference number 570.

FIG. 5B—Case 26—Constrained—Objective

Referring to FIG. 5B, an objective evaluation at a known Source (left) and at a Solution (right) for case 26.

FIG. 6A—Case 26—Unconstrained—Plan

Referring to FIG. 6A, a plan view full bounds is illustrated for case 26. Potential sources are depicted with a known source 660. The solution is shown by reference number 670.

FIG. 6B—Case 26—Unconstrained—Objective

Referring to FIG. 6B, an objective evaluation at a known Source (left) and at a Solution (right) is illustrated for case 26.

Multiple Cones

In the preceding example, FIGS. 4E and 4F both indicate the presence of one or more possible cones. The cone selection process dictates which is returned as the key cone, if only one is sought with the assumption of a single leak. In reality, however, we may encounter multiple leaks, and the cone generation plots effectively identify them. For example, in FIG. 7A there are 2 distinct cones in almost diametrically opposite directions. The selected cone correctly entraps the known source as shown in FIG. 7B. Clearly, the alternate cone would face in the wrong direction. This indicates a leak that is outside of the bounds of the search site. This information can also be used for cone selection.

Figure 7A:
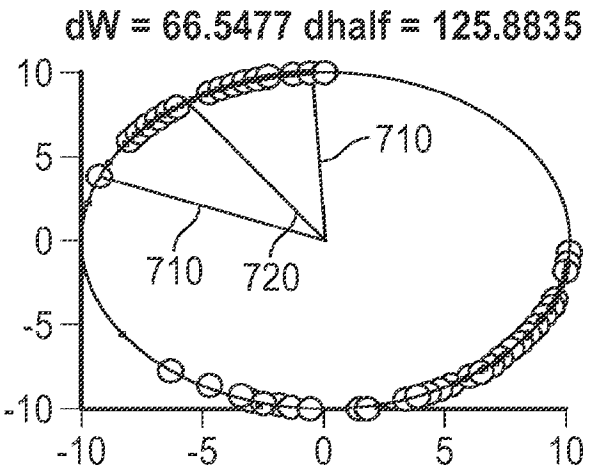
FIG. 7A is a graph of multiple cones with linear cuts, mid angle cuts and sub-bounds for a sensor 18.
Figure 7A:
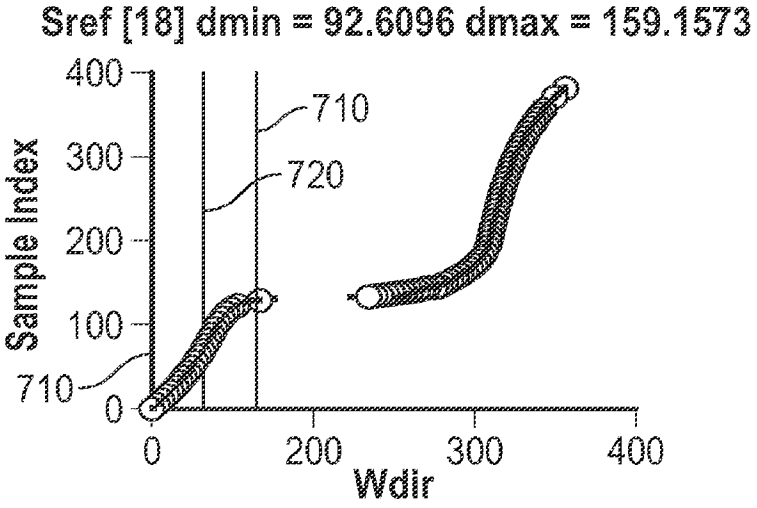
Figure 7A:
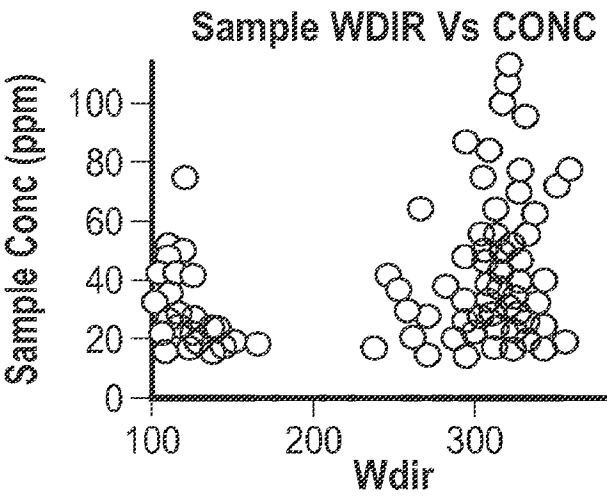
Figure 7B:
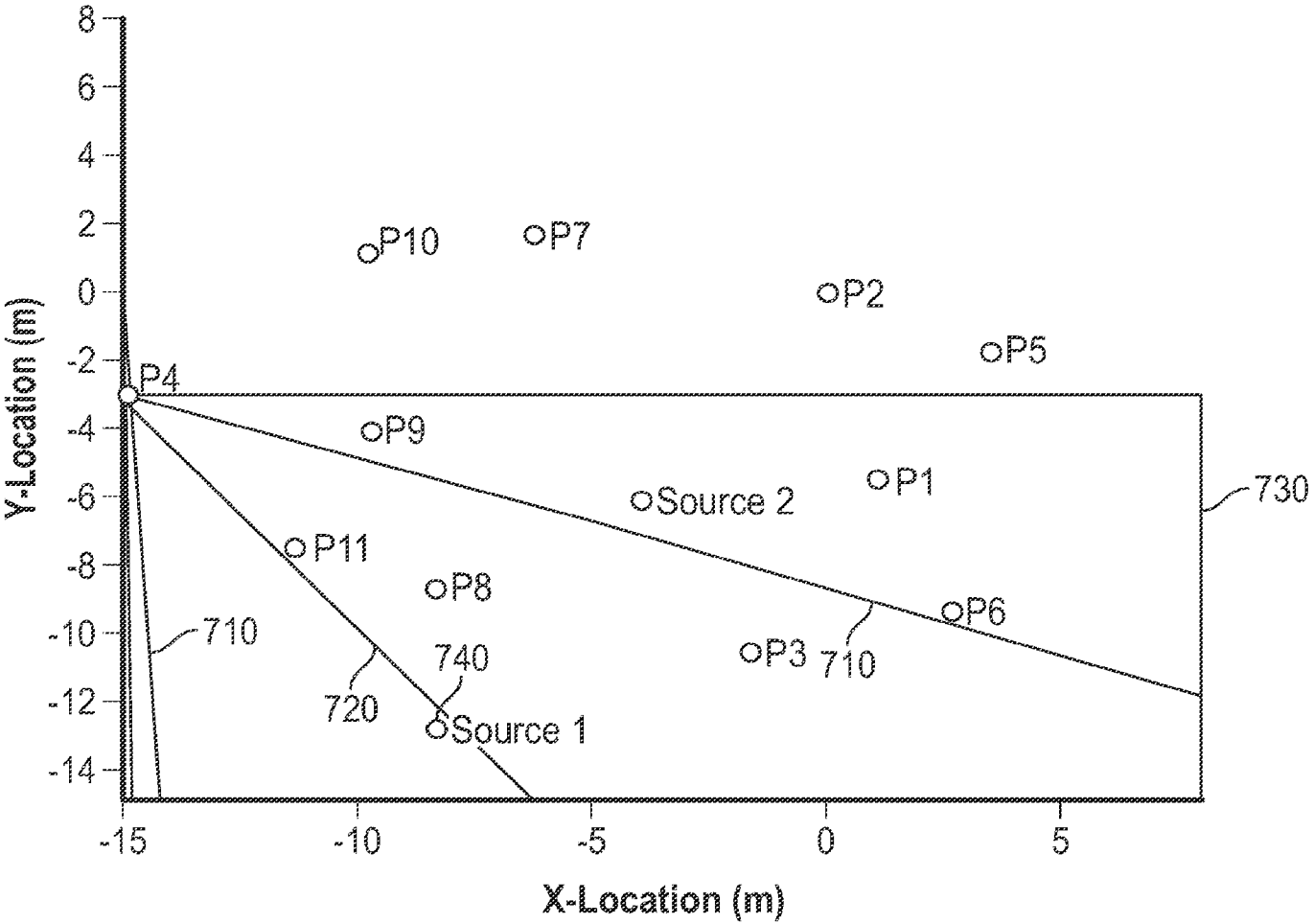
FIG. 7B is a graph of a single cone with linear cuts, mid angle cuts and sub-bounds.

FIG. 7A—Multiple Cones—Sensor 18

Referring to FIG. 7A, a cone generation plot for a sensor 18 for an example in which multiple leaks are encountered is shown. FIG. 7A illustrates wind direction vs. sample index in the top left plot, circular direction plot in the top right plot, and wind direction vs. concentration (ppm) in the bottom plot. Active samples are depicted with circles, inactive samples are depicted with dots, angles ($d_{min}$ and $d_{max}$) are shown by reference line 710, and the mid-angle is shown by reference line 720.

FIG. 7B—Multiple Cones—Valid Cone Selected

Referring to FIG. 7B, a plan view with linear cuts 710, mid-angle 720, and sub-bounds 730 is shown. Potential sources are shown with the correct source 740 entrapped within the cone created by the linear cuts 710.

Figure 8A:
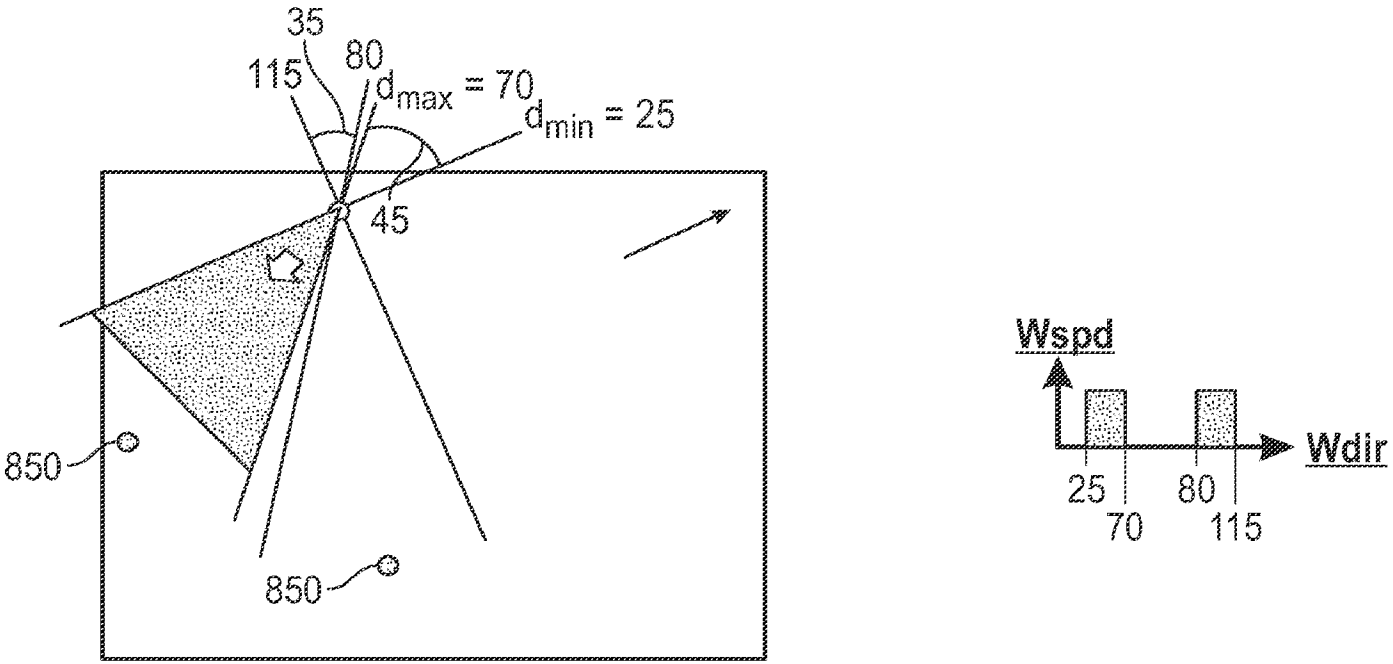
FIG. 8A is a graph of two cones permitting dis-ambiguation of two potential sources.
Figure 8B:
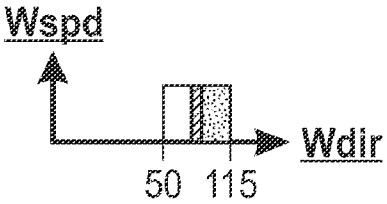
FIG. 8B is a graph of one large cone which prevents dis-ambiguation of two potential sources.
Figure 8B:
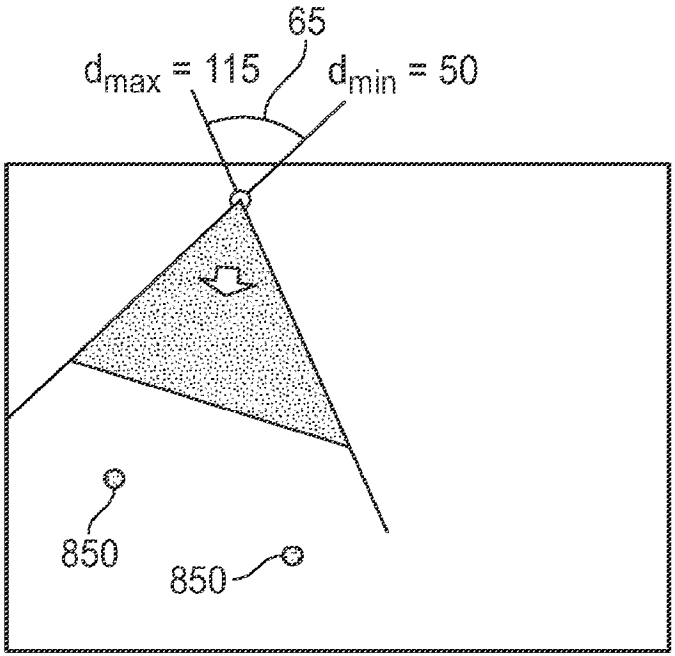

It is worth noting that identification of multiple valid cones within the search bounds effectively permits disambiguation of multiple sources. FIG. 8A shows the case where two potential sources 850 can be identified, while FIG. 8B shows the case where the two potential sources 850 cannot be separated. For the former case, information from one or more sensors could help identify multiple feasible sub-spaces. It is envisaged that each sub-space can be treated in turn as per the procedure described herein, where one source is assumed in the inversion step. This requires additional book-keeping to manage the sub-spaces identified.

FIG. 8A—Multiple Cones—Separable

FIG. 8A shows two cones permitting dis-ambiguation of two potential sources (orange circles).

FIG. 8B—Multiple Cones—Non-Separable

FIG. 8B shows one large cone which prevents dis-ambiguation of two potential sources (orange circles).

In one example embodiment, a method for evaluating the presence of a methane leak is disclosed. The method may comprise performing a record generation event and performing a quality assessment of the record generation event. The method may also comprise performing a linear cut generation procedure to create a linear cut generation data set. The method may further comprise performing a source term inversion using the linear cut generation data set.

In another example embodiment, the method may further comprise establishing a wait period and pausing the method for a duration of the wait period.

In another example embodiment, the method may further comprise repeating the method.

In another example embodiment, the method may be performed wherein the record generation event involved, at least in part, sampling data from a number of fixed methane sensors deployed at a given site.

In another example embodiment, the method may be performed wherein the given site has known boundary conditions.

In another example embodiment, the method may be performed wherein the record generation event further includes recording data of at least one of wind speed and direction.

In another example embodiment, the method may be performed wherein the record generation event further includes recording at least one of a solar intensity and cloud cover for the given site.

In another example embodiment, the method may further comprise performing at least one single cone evaluation.

In another example embodiment, the method may be performed wherein the single cone evaluation comprises determining a minimum permissible size cone for the methane leak, wherein the cone represents a pathway for methane contaminants.

In another example embodiment, the method may be performed wherein the recorded data of wind speed and direction are filtered based on concentration above a minimum detection threshold.

In another example embodiment, the method may be performed wherein the recorded data of wind speed and direction are filtered based on wind speed strength.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may be varied in many ways. Such variations are not to be regarded as a departure from the disclosure, and all such modifications are intended to be included within the scope of the disclosure.

While embodiments have been described herein, those skilled in the art, having benefit of this disclosure, will appreciate that other embodiments are envisioned that do not depart from the inventive scope. Accordingly, the scope of the present claims or any subsequent claims shall not be unduly limited by the description of the embodiments described herein.

What is claimed is:

1. A method for evaluating a presence of a methane leak, comprising:

receiving wind data from a first plurality of sensors at a plurality of locations, wherein each sensor of the first plurality of sensors corresponds to a respective location of the plurality of locations, and wherein the wind data comprises wind direction data and wind speed data;

receiving methane concentration data from a second plurality of sensors at the plurality of locations, wherein each sensor of the second plurality of sensors corresponds to the respective location of the plurality of locations;

identifying a portion of the methane concentration data having a methane concentration greater than a threshold;

performing a record generation event by generating a plurality of plots based on the methane concentration data and the wind data for each of the plurality of locations;

performing a linear cut generation procedure to create a linear cut generation data set for each of the plurality of plots, wherein the linear cut generation data set comprises two linear cuts based on a minimum angle of receptivity and a maximum angle of receptivity corresponding to the portion of the methane concentration data, wherein the two linear cuts are associated with a cone corresponding to a respective sensor of the first plurality of sensors;

determining a sub-space corresponding to the methane leak based on an overlap between each cone corresponding to the respective sensor of the first plurality of sensors; and performing a source term inversion using the linear cut generation data set and the sub-space, wherein a source of the methane leak is identified within the sub-space based on the portion of the methane concentration data and the two linear cuts.

2. The method of claim 1, further comprising:

pausing the method for a wait period subsequent to receiving the wind data and the methane concentration data;

receiving second wind data from the first plurality of sensors; and receiving second methane concentration data from the second plurality of sensors.

3. The method of claim 2, further comprising:

pausing the method for an additional wait period subsequent to receiving the second wind data and the second methane concentration data;

receiving third wind data from the first plurality of sensors; and receiving third methane concentration data from the second plurality of sensors.

4. The method of claim 1, wherein the record generation event comprises sampling the methane concentration data from the second plurality of sensors.

5. The method of claim 1, wherein a site corresponding to the plurality of locations has known boundary conditions.

6. The method of claim 1, wherein the record generation event further comprises recording a solar intensity, a cloud cover, or both for the plurality of locations.

7. The method of claim 1, further comprising:

performing a single cone evaluation, wherein the single cone evaluation comprises ranking the cone and an additional cone corresponding to the respective sensor of the first plurality of sensors based at least in part on the plurality of plots; and selecting a dominant cone based on the ranking.

8. The method of claim 7, wherein the single cone evaluation further comprises determining a minimum permissible cone size for the cone and the additional cone, wherein the cone represents a pathway for methane contaminants.

9. The method of claim 1, further comprising filtering the wind data based on the portion of the methane concentration data.

10. The method of claim 1, further comprising filtering the wind data based on a wind speed strength.

11. A method for evaluating a presence of two methane leaks, comprising:

receiving first wind data from a first sensor at a first location, wherein the first wind data comprises first wind direction data and first wind speed data;

receiving second wind data from a second sensor at a second location, wherein the second wind data comprises second wind direction data and second wind speed data;

receiving methane concentration data from a plurality of sensors at the first location and the second location;

identifying a portion of the methane concentration data having a methane concentration greater than a threshold;

performing a record generation event by:

generating a first plurality of plots based on the methane concentration data and the first wind data; and generating a second plurality of plots based on the methane concentration data and the second wind data;

performing a first linear cut generation procedure to create a first linear cut generation data set for each of the first plurality of plots, wherein the first linear cut generation data set comprises two first linear cuts based on a first minimum angle of receptivity and a first maximum angle of receptivity corresponding to the portion of the methane concentration data, wherein the two first linear cuts are associated with a first cone corresponding to the first sensor;

performing a second linear cut generation procedure to create a second linear cut generation data set for each of the second plurality of plots, wherein the second linear cut generation data set comprises two second linear cuts based on a second minimum angle of receptivity and a second maximum angle of receptivity corresponding to the portion of the methane concentration data, wherein the two second linear cuts are associated with a second cone corresponding to the second sensor;

determining a first sub-space corresponding to a first methane leak of the two methane leaks based on a first overlap between the first cone corresponding to the first sensor;

determining a second sub-space corresponding to a second methane leak of the two methane leaks based on a second overlap between the second cone corresponding to the second sensor; and performing a source term inversion of the first linear cut generation data set, the second linear cut generation data set, the first sub-space, and the second sub-space, wherein a first source of the first methane leak is identified within the first sub-space based on the portion of the methane concentration data and the two first linear cuts, and wherein a second source of the second methane leak is identified within the second sub-space based on the portion of the methane concentration data and the two second linear cuts.

12. The method of claim 11, further comprising:

pausing the method for a wait period subsequent to receiving the first wind data and the methane concentration data;

receiving the second wind data after the wait period; and receiving second methane concentration data from the plurality of sensors after the wait period.

13. The method of claim 12, further comprising:

pausing the method for an additional wait period subsequent to receiving the second wind data and the second methane concentration data;

receiving third wind data from the first sensor after the additional wait period; and receiving third methane concentration data from the plurality of sensors after the additional wait period.

14. The method of claim 11, wherein a site corresponding to the first location and the second location comprises one or more boundary conditions.

15. The method of claim 11, wherein performing the record generation event comprises recording at least one of a solar intensity and a cloud cover for the first location.

16. The method of claim 11, further comprising filtering the first wind data based on the portion of the methane concentration data.

17. The method of claim 11, further comprising filtering the first wind data based on a wind speed strength.

18. The method of claim 11, comprising determining that the first cone is an invalid cone based on cone acceptance criteria.

19. The method of claim 18, wherein the cone acceptance criteria comprise a minimum permissible cone size.

* * * * *